US007445315B2

(12) United States Patent
Young et al.

(10) Patent No.: US 7,445,315 B2
(45) Date of Patent: Nov. 4, 2008

(54) THIN FILM AND THICK FILM HEATER AND CONTROL ARCHITECTURE FOR A LIQUID DROP EJECTOR

(75) Inventors: Michael Yu Tak Young, Cupertino, CA (US); Steven A. Buhler, Sunnyvale, CA (US); Scott Jong Ho Limb, Palo Alto, CA (US); Karl A. Littau, Palo Alto, CA (US); Beverly J. Russo, Sunnyvale, CA (US); Scott E. Solberg, Mountain View, CA (US); Michael C. Weisberg, Woodside, CA (US); Cathie J. Burke, Rochester, NY (US); Richard Schmachtenberg, Aloha, OR (US); Peter J. Nystrom, Webster, NY (US); Sharon Berger, Canby, OR (US); Timothy Trang, Portland, OR (US); Thomas Long, Corbett, OR (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 146 days.

(21) Appl. No.: 10/990,110

(22) Filed: Nov. 15, 2004

(65) Prior Publication Data

US 2006/0103695 A1 May 18, 2006

(51) Int. Cl.
*B41J 2/05* (2006.01)

(52) U.S. Cl. ..... 347/56; 347/62

(58) Field of Classification Search ..... 347/51–67, 347/14, 17, 19–20

See application file for complete search history.

(56) References Cited

U.S. PATENT DOCUMENTS

| | | | | |
|---|---|---|---|---|
| 4,418,355 | A | 11/1983 | DeYoung et al. | 347/70 |
| 4,811,237 | A | 3/1989 | Putatunda et al. | 716/9 |
| 4,857,711 | A | 8/1989 | Watts | 439/752 |
| 4,931,627 | A | 6/1990 | Watts | 219/548 |
| 5,075,690 | A | 12/1991 | Kneezel | 347/17 |
| 5,083,143 | A | 1/1992 | Hoffman | 347/20 |
| 5,087,930 | A | 2/1992 | Roy et al. | 347/85 |
| 5,175,565 | A * | 12/1992 | Ishinaga et al. | 347/17 |
| 5,315,316 | A | 5/1994 | Khormaee | 347/3 |
| 5,406,361 | A | 4/1995 | Kim | 399/70 |
| 5,424,767 | A | 6/1995 | Alavizadeh et al. | 347/17 |
| 5,428,206 | A | 6/1995 | Uchida et al. | 219/505 |
| 5,881,451 | A | 3/1999 | Kneezel | 347/14 |
| 5,989,757 | A | 11/1999 | Ito et al. | 430/7 |
| 6,007,183 | A | 12/1999 | Horine | 347/46 |
| 6,019,814 | A | 2/2000 | Horine | 75/335 |
| 6,248,151 | B1 | 6/2001 | Horine | 75/335 |
| 6,350,405 | B2 | 2/2002 | Horine | 266/202 |
| 6,416,164 | B1 | 7/2002 | Stearns et al. | 347/46 |
| 6,495,809 | B2 | 12/2002 | Bulgajewski et al. | 219/548 |

(Continued)

*Primary Examiner*—Juanita D Stephens
(74) *Attorney, Agent, or Firm*—Fay Sharpe LLP

(57) ABSTRACT

A liquid drop ejector comprising a jet stack, thin film or thick film heaters formed on the surface of the jet stack, and at least one thin film or thick film temperature sensor operative to provide feedback temperature control for the thin film or thick film heater elements is provided. In one form, the liquid drop ejector also has the thin film or thick film heater elements grouped in segments that are operative to be individually controlled. In addition, in another form, the signal lines provided to the liquid drop ejector are patterned to allow for more uniform resistance over the span of the liquid drop ejector.

22 Claims, 17 Drawing Sheets

U.S. PATENT DOCUMENTS

| | | | | |
|---|---|---|---|---|
| 6,536,889 | B1 | 3/2003 | Biegelsen et al. | 347/95 |
| 6,548,308 | B2 | 4/2003 | Ellson et al. | 347/47 |
| 6,561,640 | B1 | 5/2003 | Young | 347/102 |
| 6,612,686 | B2 | 9/2003 | Mutz et al. | 347/46 |
| 6,742,884 | B2 | 6/2004 | Wong et al. | 347/14 |
| 6,720,119 | B2 | 7/2004 | Ito et al. | 436/7 |
| 6,967,431 | B2 | 11/2005 | Buhler et al. | 310/330 |

* cited by examiner

THIN FILM AND THICK FILM HEATER AND CONTROL ARCHITECTURE FOR A LIQUID DROP EJECTOR

BACKGROUND

The presently described embodiments relate to a thin film or thick film heater and control architecture for an ink jet liquid drop ejector. They find particular application in conjunction with ink jet liquid drop ejector (known in the art as print heads) useful for emitting phase change inks, and will be described with particular reference thereto. However, it is to be appreciated that the presently described embodiments are also amenable to other like applications where liquid material can be ejected with the benefit of ejector temperature regulation. Such liquid jettable material can be ink jet printer ink, liquid metal, color filter material, photoresist material, curable resin, bio-reagents or even chocolate (food) etc.

By way of background, different types of droplet ejectors are known. Selective applications shall be reviewed here for illustration purposes. U.S. Pat. No. 6,007,183 (Dec. 28, 1999) entitled "Acoustic Metal Jet Fabrication using an Inert Gas", U.S. Pat. No. 6,019,814 (Feb. 1, 2000) entitled "Method of Manufacturing 3D Parts using a Sacrificial Material", U.S. Pat. No. 6,248,151 (Jun. 19, 2001) entitled "Method of Manufacturing Three Dimensional Parts using an Inert Gas" and U.S. Pat. No. 6,350,405 (Feb. 26, 2002) entitled "Apparatus for Manufacturing Three Dimensional Parts using an Inert Gas", all to Horine, describe liquid drop ejectors which ejects liquid metal, such as hot solder and other similar material to make 3D parts. U.S. Pat. No. 6,416,164 (Jul. 9, 2002) to Stearns et al., entitled "Acoustic Ejection of Fluids using Large F-Number Focusing Elements", U.S. Pat. No. 6,548,308 (Apr. 15, 2003) to Ellson et al., entitled "Focused Acoustic Energy Method and Device for Generating Droplets of Immiscible Fluids", and, U.S. Pat. No. 6,612,686 (Sep. 2, 2003) to Mutz et al. entitled "Focused Acoustic Energy in the Preparation and Screening of Combinatorial Libraries" are application examples where bio-reagents can be ejected from a liquid drop ejector. U.S. Pat. No. 6,742,884 (Jun. 1, 2004) to Wong et al., entitled "Apparatus for Printing Etch Masks using Phase-change Materials" is an example of printing phase change materials for the purpose of fabricating electronic circuit and devices. U.S. Pat. No. 5,989,757 (Nov. 23, 1999) entitled "Color Filter Manufacturing Method" and U.S. Pat. No. 6,720,119 (Jul. 6, 2004) to Ito et al., entitled "System and Methods for Manufacturing a Color Filter using a Scanning Ink Jet Head" describe methods of using an ink jet liquid drop ejector to eject color filter material. U.S. Pat. No. 6,561,640 (May 13, 2003) to Young, entitled "Systems and Methods of Printing with Ultraviolet Photosensitive Resin-containing Materials using Light Emitting Devices" and U.S. Pat. No. 6,536,889 (Mar. 25, 2003) to Biegelsen et al. entitled "Systems and Methods for Ejecting or Depositing Substances containing Multiple Photoinitiators" are other examples of ejecting resin-containing materials. These illustrated applications can greatly benefit from the presently described embodiment of integrated thin film or thick film heater and control architecture for such temperature regulated liquid drop ejectors.

The use of heaters on liquid drop ejectors that emit phase change ink is well known. The phase change ink is solid at room temperature and a jettable liquid at about 130 degrees to 140 degree Celsius. This temperature dependent viscosity can affect ink drop ejection velocity which can impact the process direction placement accuracy of ink drops on a rotating drum or substrate medium. A typical ink jet velocity change with temperature is about two to three percent per degree Celsius. Typical viscosity for these phase change ink at jetting temperature is about 10 to 15 centipoise. Several phase change ink drop ejectors with externally attached heater elements and thermistors are known. For example, U.S. Pat. No. 4,418,355 to DeYoung et al, (Nov. 29, 1983) for an "Ink Jet Apparatus with Preloaded Diaphragm and Method of Making Same" describes an early version of a reciprocating ink jet head with an attached heater element and a discrete thermistor temperature sensor. U.S. Pat. No. 5,087,930 to Roy et al. (Feb. 11, 1992) for a "Drop-on-demand Ink Jet Print Head" and U.S. Pat. No. 5,083,143 to Hoffman (Jan. 21, 1992) for "Rotational Adjustment of an Ink Jet Head" provide some background description of a 9.5 cm wide, 96 jets, reciprocating carriage version of such a phase change ink print head.

One embodiment of a full media width phase change ink or liquid drop ejector is disclosed in U.S. Pat. No. 5,424,767 ("the '767 patent") to Alavizadeh et al. (Jun. 13, 1995) for an "Apparatus and Method for Heating Ink to a Uniform Temperature in a Multiple-orifice Phase-change Ink-jet Print Head". In this regard, as disclosed in the '767 patent, FIG. 1 is an isometric exploded view showing the positioning of media-width liquid drop ejector 44 relative to liquid drop ejector heater 58, flex circuit 62, ink reservoir 52, ink premelt chambers 54C, 54M, 54Y, and 54K, and cartridge heaters 56. Cartridge heaters 56 are inserted into a heat distribution bar 100 that is assembled in thermal contact with reservoir 52 and ink premelt chambers 54. The temperature of heat distribution bar 100 is sensed by a thermistor 102 (shown in phantom) that, in combination with a conventional zero crossing integer cycle temperature controller, regulates the temperature of heat distribution bar 100, reservoir 52, and premelt chambers 54. Their combined thermal mass is such that the temperature controller has a relatively slow 90 second thermal response time, which is sufficient for ink melting, storage, and distribution purposes.

In contrast, liquid drop ejector 44 employs a faster thermal response time of about three to about seven seconds to respond to temperature changes caused by the above-described thermal transfer mechanisms, printer mode-related temperature changes, and heat lost by ejecting dense ink patterns. The temperature of liquid drop ejector 44 is sensed by a thermistor 104 (shown in phantom) that is inserted into a well in liquid drop ejector 44 and controlled as above by the temperature controller which powers liquid drop ejector heater 58.

Liquid drop ejector 44 is mated to reservoir 52 along a rectangular surface contact region 92 (shown in dashed lines). Contact region 92 on reservoir 52 includes four rows of ink ports 106 through which liquid drop ejector 44 receives melted yellow, magenta, cyan, and black ink. Contact region 92 on printhead 44 includes four rows of mating ink ports (not shown) that are separated from and positioned below four rows of orifices 46. The difference of thermal response times on either side of contact region 92 prevents thermal oscillation between the liquid drop ejector and reservoir-related temperature control loops.

Liquid drop ejector heater 58 is bonded to the rear surface of liquid drop ejector 44 just adjacent to and above contact region 92. A cutout region 108 in liquid drop ejector heater 58 accommodates the area required by the piezoelectric transducers (not shown) that drive rows of orifices 46. The piezoelectric transducers are electrically connected to driver circuits 60 by flex circuit 62.

Alternatively, cutout region 108 can be eliminated if liquid drop ejector heater 58 is bonded to the major surface of flex circuit 62 facing away from printhead 44. In this embodiment, heat from liquid drop ejector heater 58 conducts through flex circuit 62 and into liquid drop ejector 44 in part through the piezoelectric transducers. The piezoelectric transducers are not good heat conductors, but neither is the stainless steel from which liquid drop ejector 44 is made. This embodiment provides a more direct heat conduction path to ink adjacent to each of orifices 46.

Notably, the phase change liquid drop ejector with the attached flexible circuit heater, as disclosed in the '767 patent, has at least some drawbacks. Because the flexible material of the heater is a thermal insulator, and because added thermal contact resistance resides in the assembly, the liquid drop ejector substrate temperature is not as responsive to changes in the flex heater temperature as may be desired. This is a disadvantage for this implementation. Other disadvantages of this configuration include higher manufacturing costs.

Another disadvantage to this type of configuration is that the flexible circuit results in a limited maximum pixel resolution—because the signal lines have inherent constraints.

Moreover, it would be desirable to implement a design that achieves good quality prints using phase change ink liquid drop ejectors. To do so, appropriate heat uniformity across the pixel zone is required.

BRIEF DESCRIPTION

In accordance with one aspect of the present exemplary embodiments, the liquid drop ejector comprises a jet stack, a pixel zone comprising columns and rows of pixel elements defined on a surface of the jet stack, thin film or thick film heater elements disposed on the surface of the jet stack in the pixel zone and at least one thin film or thick film temperature sensor operative to provide feedback temperature control for the thin film or thick film heater elements.

In accordance with another aspect of the presently described embodiments, the thin film or thick film heater elements and/or the thin film or thick film temperature sensors are formed of material with positive or negative temperature coefficient of electrical resistance.

In accordance with another aspect of the present exemplary embodiments, the jet stack comprises stainless steel material.

In accordance with another aspect of the present exemplary embodiments, the heater elements form loops encompassing selected columns of pixels. In accordance with another aspect of the present exemplary embodiments, the liquid drop ejector further comprises second heater elements formed of material with positive or negative temperature coefficient of electrical resistance on the surface of the jet stack outside the pixel zone.

In accordance with another aspect of the present exemplary embodiments, the thin film or thick film heater elements are operative to be individually controlled.

In accordance with another aspect of the present exemplary embodiments, the thin film or thick film heaters are grouped in heater segments, the segments being operative to be individually controlled.

In accordance with another aspect of the present exemplary embodiments, adjacent segments are positioned in an overlapping configuration.

In accordance with another aspect of the present exemplary embodiments, the pixel elements are each connected to an input/output pad by a signal line, selected signal lines having a first width near corresponding pads that is less than a second width near corresponding pixel elements.

In accordance with another aspect of the present exemplary embodiments, an increase in width from the first width to the second width is progressive.

In accordance with another aspect of the present exemplary embodiments, the signal lines are formed of a thin film or thick film material with positive or negative temperature coefficient of electrical resistance.

In accordance with another aspect of the present exemplary embodiments, a method for forming the liquid drop ejector comprises providing a jet stack having a surface with a pixel zone defined therein, the pixel zone comprising columns and rows of pixel elements, forming a dielectric layer on the surface of the jet stack, and forming a metal layer on the dielectric layer, and patterning thin film or thick film heater elements in the metal layer.

In accordance with another aspect of the present exemplary embodiments, the metal layer is a positive temperature coefficient of resistance material.

In accordance with another aspect of the present exemplary embodiments, the metal layer is chrome.

In accordance with another aspect of the present exemplary embodiments, the patterning further comprises patterning at least one of a temperature sensor, additional heater elements, bond pads, and signal lines connecting the pixel elements to the bond pads.

In accordance with another aspect of the present exemplary embodiments, depending on construction, the temperature sensor formed of thin or thick film material can be a thermistor or a thermocouple.

In accordance with another aspect of the present exemplary embodiments, depending on construction, the temperature sensor made of thin or thick film material can be a common centroid temperature sensor—having the benefit of the measured temperature being independent of process and temperature variability of resistor line width, resistor line width gradient and temperature gradient.

In accordance with another aspect of the present exemplary embodiments, the temperature sensor made of thin or thick film material can have the characteristics of thermal shield guarding and/or electrical shield guarding.

DETAILED DESCRIPTION

The presently described embodiments provide for improvements in temperature regulated ink jet type of liquid drop ejectors used for emitting phase change ink or other jettable material such as liquid metal, color filter material, photoresist material, curable resin or bio-reagents, etc. In this regard, a thin film or thick film integrated heater and temperature sensor design is provided. The presently described embodiments result in improved thermal coupling of this thin film heating system to a substrate such as a stainless steel substrate. Advantageously, processes associated with thin film or thick film material and integrated circuit manufacturing are used. The thin film or thick film heater provides direct heating of a stainless steel jet stack to a desired ink temperature for proper ink jet operation and achieves better thermal heating efficiency than prior art heaters. The temperature sensor allows for direct monitoring of the substrate temperature for better feedback control. In addition, by integrating the thin film or thick film heater and temperature sensor functionality directly onto the phase change ink liquid drop ejector, higher performance (shorter printhead heat-up time, reduced peak heater electrical power equipment, potential for higher pixel resolution and interconnect integration, etc.) and reduced manufacturing costs are realized.

In addition, in at least one form, the presently described embodiments implement independent temperature regulation for subdivided sections of a phase change ink liquid drop ejector. The segmented and independently regulated temperature control zones make possible a more uniform temperature profile across the liquid drop ejector. Furthermore, these temperature control zones can be made to coincide with various paper media width requirements, making "on demand" paper width temperature profiles possible.

Still further, in at least one form, the present exemplary embodiments optionally provide a technique of impedance matching by, for example, progressively widening the pixel feed interconnect lines, or signal lines, as the signal lines traverse through pixel rows to reach their pixel element destination. By progressively widening the signal lines, the line resistance for the furthest row from the bond, or input/output, pads to the closest row from the bond pads are within an acceptable range for signal propagation. This narrows the signal line variation range from row to row and makes overall print normalization achievable.

Figure 1:
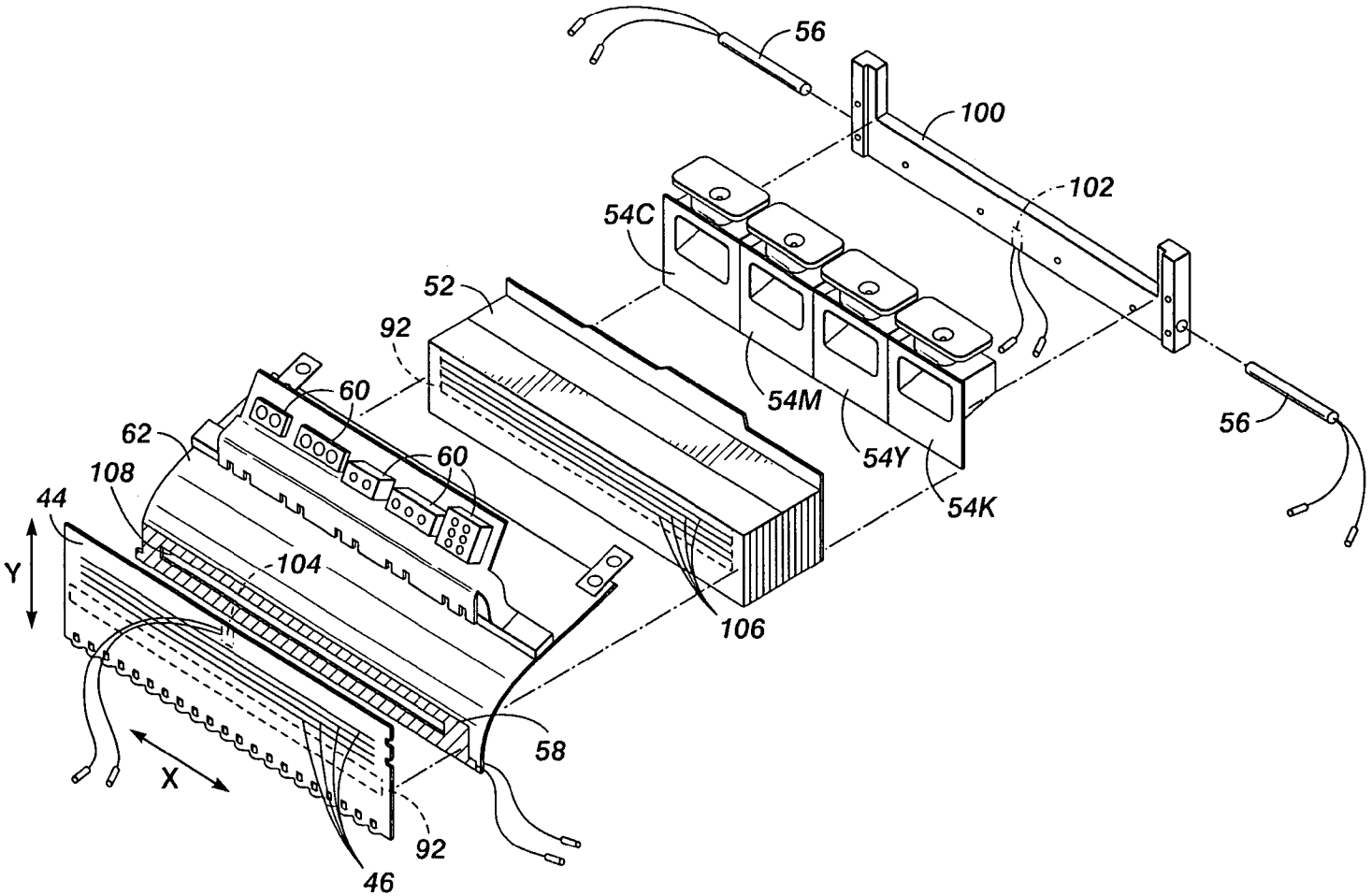
FIG. 1 is a plan view of a prior art ink jet liquid drop ejector configuration.
Figure 2:
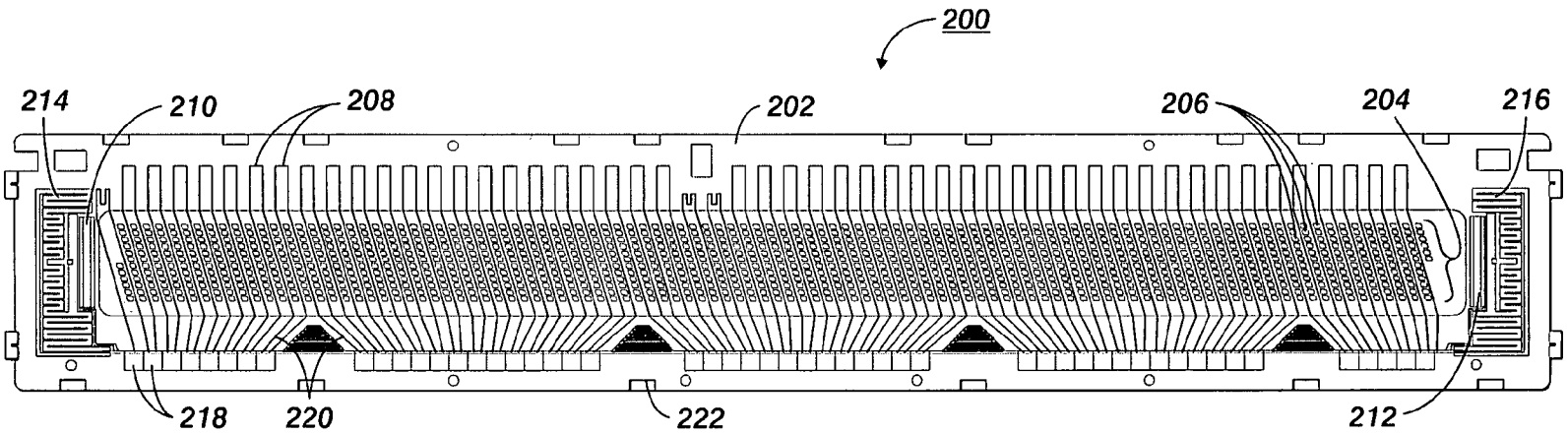
FIG. 2 is an illustration of a liquid drop ejector according to the present exemplary embodiments.

With reference to FIG. 2, a liquid drop ejector 200 is shown. The liquid drop ejector 200 includes a jet stack 202 having a pixel zone 204 disposed therein. The jet stack is, in one form, made from layers of stainless steel that are configured to form ink channels and orifices for ejecting ink, as will be apparent from the description of FIGS. 10 through 20. One side of the jet stack serves as the jetting side (from where the ink is ejected) while the opposite side serves as the actuator side (having the actuating elements connected thereto). In FIG. 2, the actuator side is shown.

The pixel zone 204 comprises pixel elements 206 arranged in columns and rows on a surface of the jet stack 202. As shown, this pixel zone is disposed in the substantially center portion of the jet stack 202. However, it should be understood that the pixels may be arranged in a variety of configurations. For example, only a single pixel element may be provided, or the pixel elements may be arranged in an irregular format or in clusters of arrays. For manufacturing purposes, a mesa is optionally formed on the surface of the jet stack and protrudes to allow for proper attachment of a metalized actuator element. This metalized actuator element is not shown but is described below in connection with, for example, FIGS. 10 through 20. Moreover, it should be understood that the pixel elements 206 are driven by a driver chip in a range of approximately minus 50 volts to plus 50 volts. Each pixel element 206 is electrically connected to an input/output (or bond) pad (described below) for communication to these driver chips (not shown). The driver chips reside on a PCB with circuitry layer, i.e., a rigid printed circuit board, which is attached to the liquid drop ejector that house the actuator element that provide the forces to eject the ink. More specifically, and as will be apparent from FIGS. 3, 4, 5, 6, 7, and 10 through 20, the actuator elements are attached to an electrically shorting copper ground strap. The ground strap is on top and away from the jetstack. The drive signals are routed on the jetstack surface coplanar to the heater elements. These drive signal and heater element I/O pads are wire bonded to the rigid driver chip printed circuit board.

This configuration is an improvement over prior systems wherein the actuator elements were attached to a flexible interposer circuit which was heat seal attached to the driver chip PCB edge. The flex circuit served as an interposer and carried the drive signals from the rigid PCB to the actuator elements. The jetstack's stainless steel body was the common electrical ground.

Thin film or thick film heater elements 208 are provided to columns of the pixel elements within the pixel zone. As will be described in greater detail and illustrated below, the heater elements 208 within the pixel zone 204 loop around columns of pixels 206 in the pixel zone 204. The liquid drop ejector 200 includes temperature sensors (e.g. thermistors) 210 and 212, as well as additional heater elements 214 and 216 which lie outside the pixel zone. The temperature sensors may include two or four terminals for input/output functions. Still further heating elements may be formed on the liquid drop ejector (e.g., near ink feed ports and bond pads) to improve watt density distribution. As alluded to above, bond pads 218 and interconnect lines 220 are also formed on the jet stack. Note that, for ease of circuit connection, these pads are located on the same edge of the jet stack. It is also notable that the interconnect lines 220 are fanned out from the bond pads as illustrated to accommodate ink feed manifold ports 222 which are positioned on the liquid drop ejector 200. This configuration of fanning out the lines also allows for improved heat dissipation.

It should be further noted that the interconnect lines 220 take two forms: heater lines and signal lines. The heater lines extend from the bond pads 218, as loops, around columns of pixel elements 206. The signal lines (although not specifically shown in FIG. 2) extend from appropriate bond pads 218 to corresponding pixel elements for control purposes. As shown, both types of lines are present in the fanned-out portions of interconnect lines 220 shown in FIG. 2. It should be understood that in one form, these electrical interconnect(s) are formed of material having a positive or negative temperature coefficient of electrical resistance (PTC or NTC) on the surface of the liquid drop ejector and make an electrical common ground connection to the ejector via an electrical insulator between the electrical interconnect and a jet stack of the ejector.

Figure 3:
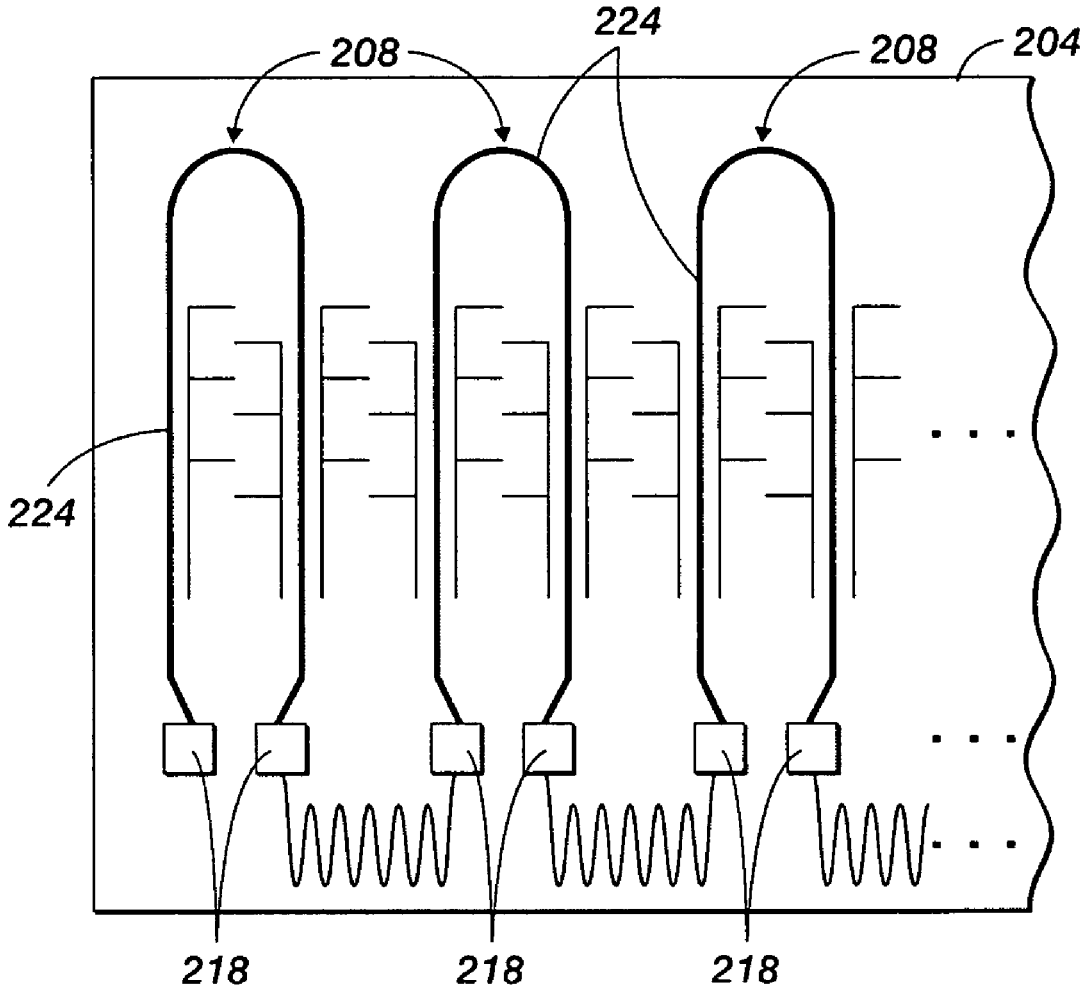
FIG. 3 is a graphic illustration of a portion of a liquid drop ejector according to the presently described embodiments.

With reference now to FIG. 3, a portion of the pixel zone 204 is illustrated. As shown, heater elements 208 include heater lines 224, encompass columns of pixel elements, and extend from the bond pads 218. The width of the loop may be determined based on a desired watt density distribution. As will be explained in further detail below, these heater elements may be individually controllable or may be grouped in segments that are individually controllable. Connecting the heater loops in a parallel configuration is advantageous in this regard because the individual heater loops can be measured and monitored. Having shorter thin film or thick film heater loops is also advantageous since this reduces the heater drive voltage to an acceptable level well below the dielectric breakdown voltage. A typical thin film heater voltage in this design will be below ~60V. This is in contrast to the ~120V flex heater used in the '767 patent where a long and serpentine heater loop trace was used.

Implementation of the thin film or thick film heater and control architecture as described in connection with the presently described embodiments, results in an integrated heating system for a liquid drop ejector that has the ability to heat the liquid drop ejector jet stack to a desired ink temperature with better thermal efficiency than prior art heaters. It is estimated that this results in energy saving of 30% or greater. The present technique also allows for a reduction in jet stack warm-up time. Moreover, the cost for the heater and thermistor functionality for the liquid drop ejector is greatly reduced from a manufacturing standpoint and also from a drive voltage and power regulation standpoint.

In addition, the use of thin film or thick film techniques also allows for more adaptability of the circuits on the printed circuit board. For example, the integrated interconnect lines are only limited by photolithography patterning techniques and, potentially, could be adapted to allow for a higher resolution liquid drop ejector.

Figure 4:
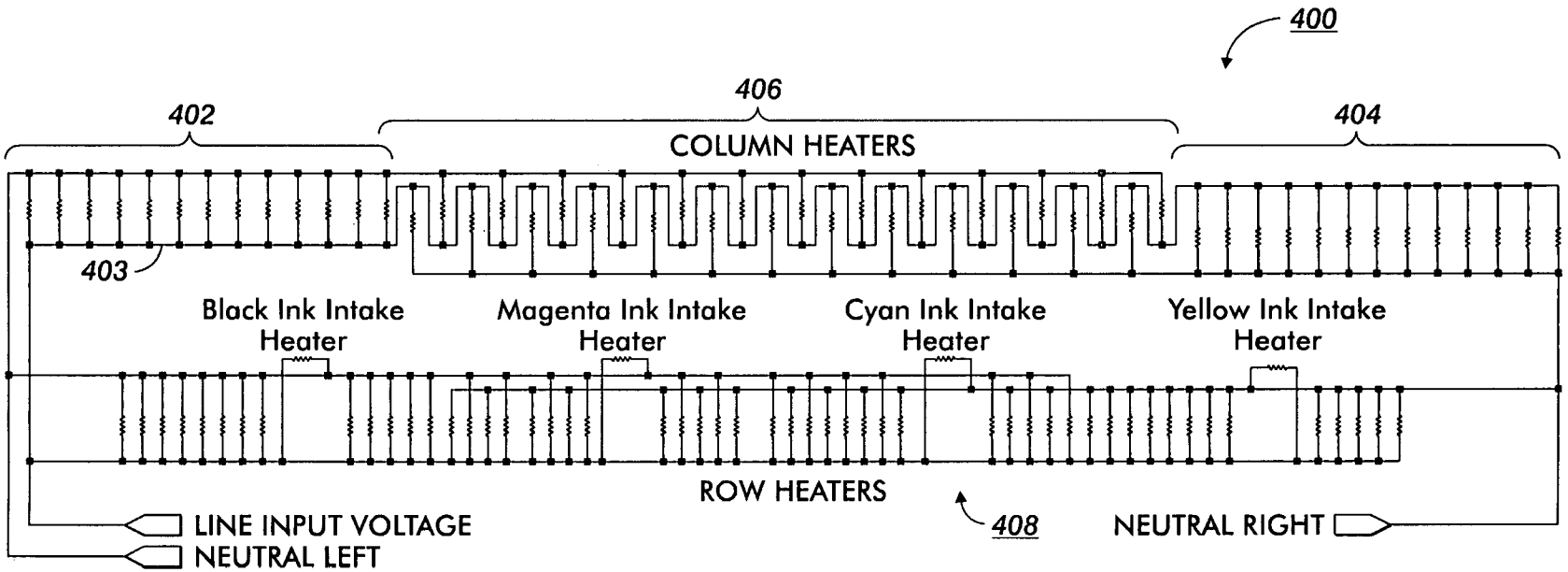
FIG. 4 is a schematic diagram illustrating a feature of the presently described embodiments.

With reference now to FIG. 4, a circuit configuration 400 of the heater elements 208 is illustrated. As shown, the circuit configuration 400 includes a first heater segment 402 and a second heater segment 404. Individual heater loops, such as heater loop 403, are illustrated. In at least one form, the heater segment 402 and heater segment 404 overlap in a region 406, resulting in improved uniform heating of the printhead 400. This overlap also avoids abrupt temperature changes at a heat zone boundary. Also shown are a plurality of additional area heaters 408 provided on the liquid drop ejector. This configuration provides for two distinct heater segments that have an overlapping region.

Figure 5:
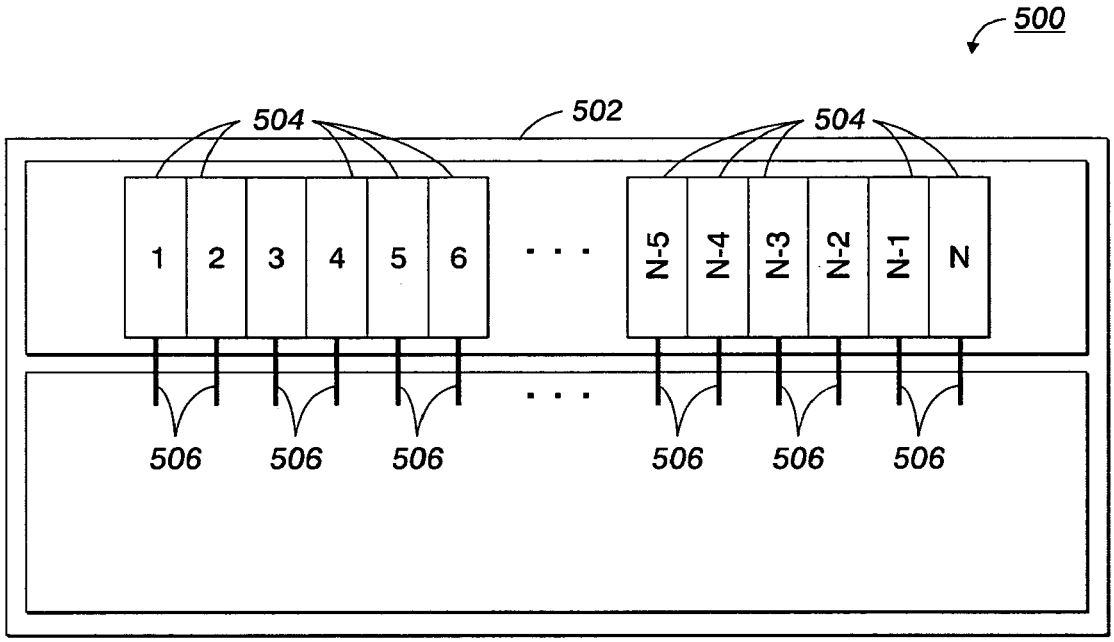
FIG. 5 is a graphic representation of a feature according to the presently described embodiments.

Referring now to FIG. 5, it should be appreciated that the liquid drop ejector may be segmented into more than two heater segments. As shown, the liquid drop ejector 500 having a pixel zone 502 has N heater segments 504 disposed thereon. As is shown, control lines 506 are implemented to individually control the heater segments 504. It should be further appreciated that the heater segments 504 may be comprised of a single heater loop encompassing a single column of pixel elements, such as that shown in FIGS. 2 and 3 as element 208, or they may comprise groups of such heater element loops.

Implementation of independently controllable thin film or thick film heater loops on a stainless steel substrate, with patterned interconnections as described, results in multiple heat zones that can be independently regulated. This regulation may occur through the use of a temperature sensing thin film or thick film temperature sensor. Regulation may also occur by sensing electrical power, electrical current or other electrical parameters delivered to the thin film or thick film heaters on the heated substrate. The multiple heat zones may be heated by direct current (DC) or alternating current (AC) that is unmodulated or modulated. Also, either direct current (DC) or alternating current (AC) heater voltage which is subject to pulse width modulation (PWM) may also be used to regulate electrical power delivery.

These features allow for the heating zones on the printhead to be configured and reconfigured supporting multiple applications. For example, multiple heat zones can be used according to paper media requirements to achieve on demand paper media width printhead heating. In this regard, segmentation of regulated heat zones can be driven by print/copy functionality or by temperature uniformity requirements. These two requirements should not conflict with each other and both requirements can be met and implemented together. This programmable on-demand heater zone width control method has a novel and distinct advantage of "Energy Star" energy savings reducing overall printer/copier wall socket power consumption. Appropriate circuitry and software is implemented to control these heat zones. However, such circuitry and software may vary from application to application. Nonetheless, in one embodiment, the heat zones are controlled by a controller that resides in, for example, the printer. The controller processes and transmits appropriate signals to the ejector in accordance with the objectives described herein. Alternatively, the controller may reside on the ejector itself.

It should also be understood that overall control of a liquid drip ejector (beyond controlling the heat zones), such as the liquid drop ejector described herein, is typically accomplished using techniques that are well known to those of skill in the art. Such techniques, of course, may be modified to accommodate the features described herein.

As an example of operation and/or implementation of multiple heating zones, it is desirable for some print/copy applications to have various print widths. An example of this requirement is printing multiple copies on postcard size media. In this case, the operating temperature heating of the jet stack may be allocated to cover just the postcard media with some paper path width margin. The rest of the jet stack can be at a stand-by temperature. This is desirable for jet stacks that use phase change ink. The stand-by temperature will keep the phase change ink in a liquid state. The heater can be turned off in unused regulated heat zones for other print/copy applications which do not need ink preheating as for phase change ink. Segmentation of regulated heat zones for a temperature uniformity requirement can have small pixel column groupings to achieve the desired localized temperature uniformity. There can be overlaps of heater loops between neighboring heat zones.

By having segmented and independently controlled heater zones on a phase change ink liquid drop ejector, a controllable temperature profile is achievable. When more that two heater zones are used, further temperature uniformity can then be achieved. By having distributed and independently controllable heater loops on the printhead, regulated heat zone definition and overlap at zone boundaries can be defined on the attached printed wiring board, which can be customized to define various temperature regulating heat zones. Thus, on demand and programmable media heat zone widths are made possible. This, of course, reduces power consumption.

Figure 6:
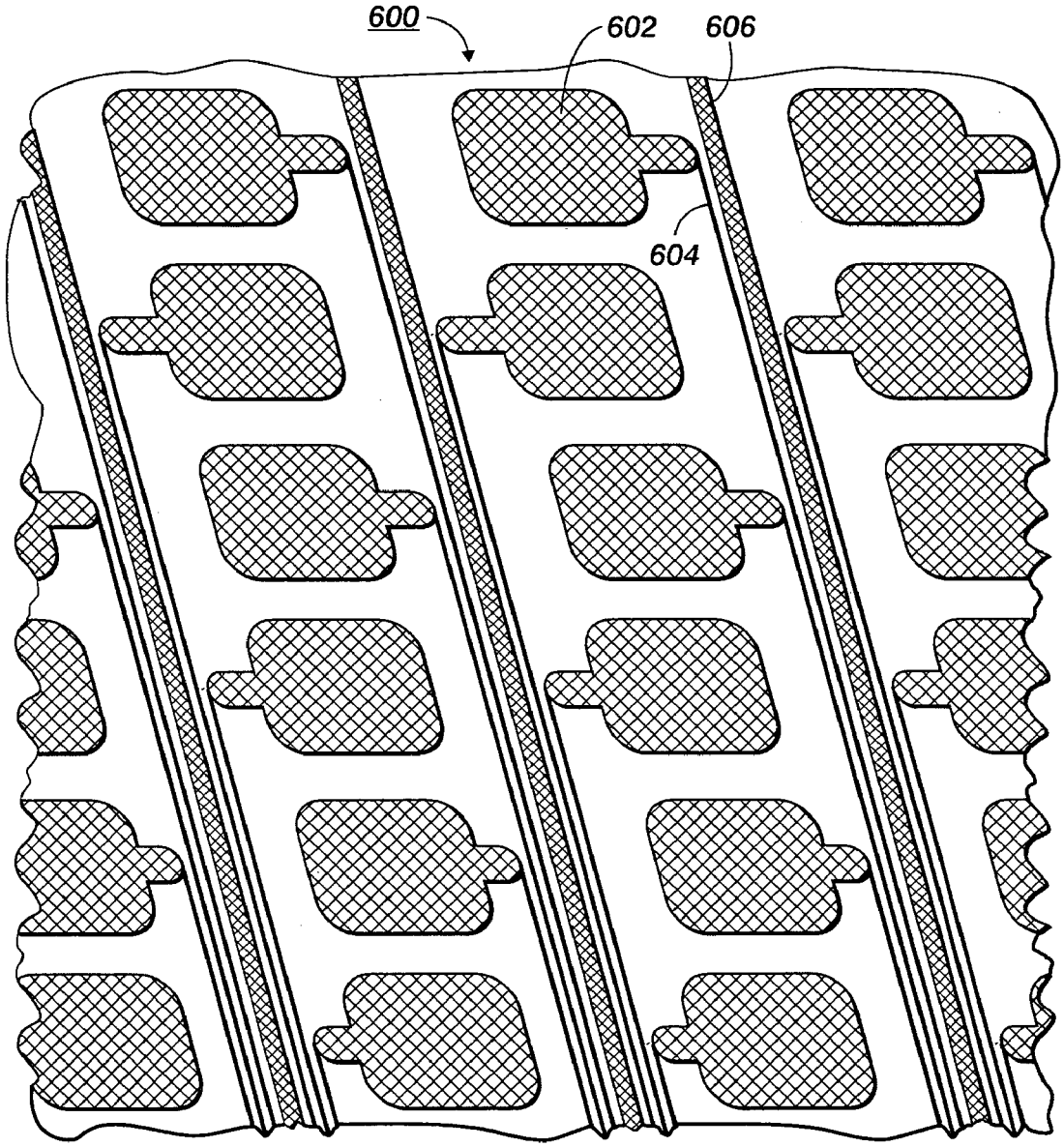
FIG. 6 is an illustration of signal lines according to the presently described embodiments.

Referring now to FIG. 6, a portion of the pixel elements of a pixel zone 600 is illustrated. In that zone, pixel elements, such as that shown at 602, are illustrated as being connected to a signal line 604. The signal line 604 extends to appropriate bond pads (not shown). Also shown in FIG. 6 are heater lines 606, which suitably loop around the columns of pixel elements, as in FIGS. 2 and 3.

Figure 7:
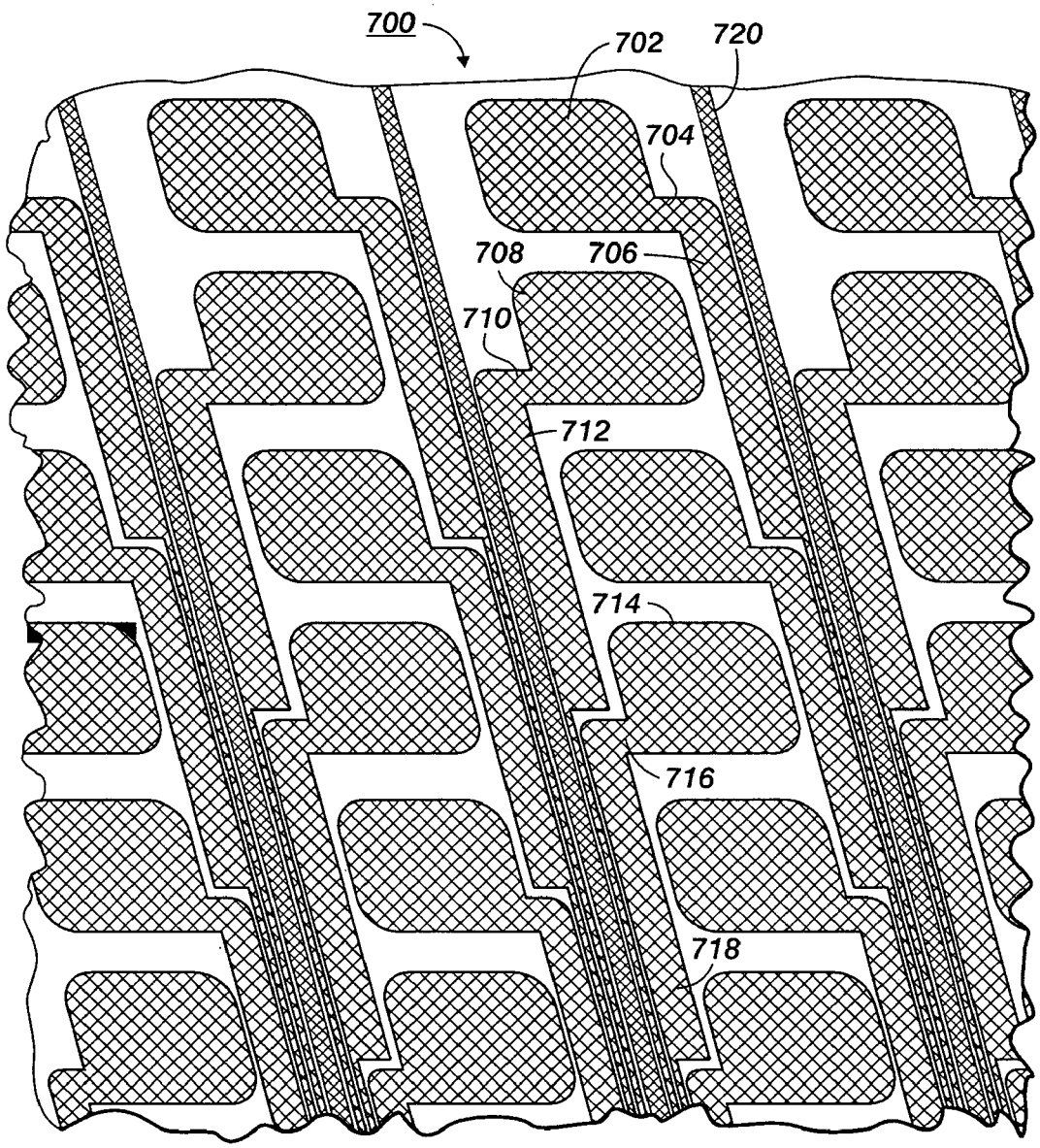
FIG. 7 is an illustration of signal lines according to the presently described embodiments.

As noted above, however, in at least one form of the presently described embodiments, the signal lines are progressively sized to reduce the amount of resistance and provide for better uniformity of signaling on the liquid drop ejector. In this regard, FIG. 7 illustrates a portion of a pixel zone 700. In that zone 700, pixel elements such as that shown at 702, have a signal line 704 that connects to an appropriate bond pad (not shown). Signal line 704 also includes an enlarged width portion 706. Likewise, pixel elements such as that shown at 708 include a signal line 710. Signal line 710 includes an enlarged width portion 712. Still further, pixel elements such as that shown at 714 have provided thereto a signal line 716. As shown, the signal line 716 includes an enlarged width portion 718. These pixel elements and signal lines are exemplary in nature and illustrate that the width of the signal line near the pixel element is greater than the width of the signal line as it progresses toward the bond pad. Note that the enlarged portion 706, enlarged portion 712 and enlarged portion 718 vary in size from largest to smallest, respectively. Also shown in FIG. 7 are the heater lines, such as that shown at 720.

Figure 8:
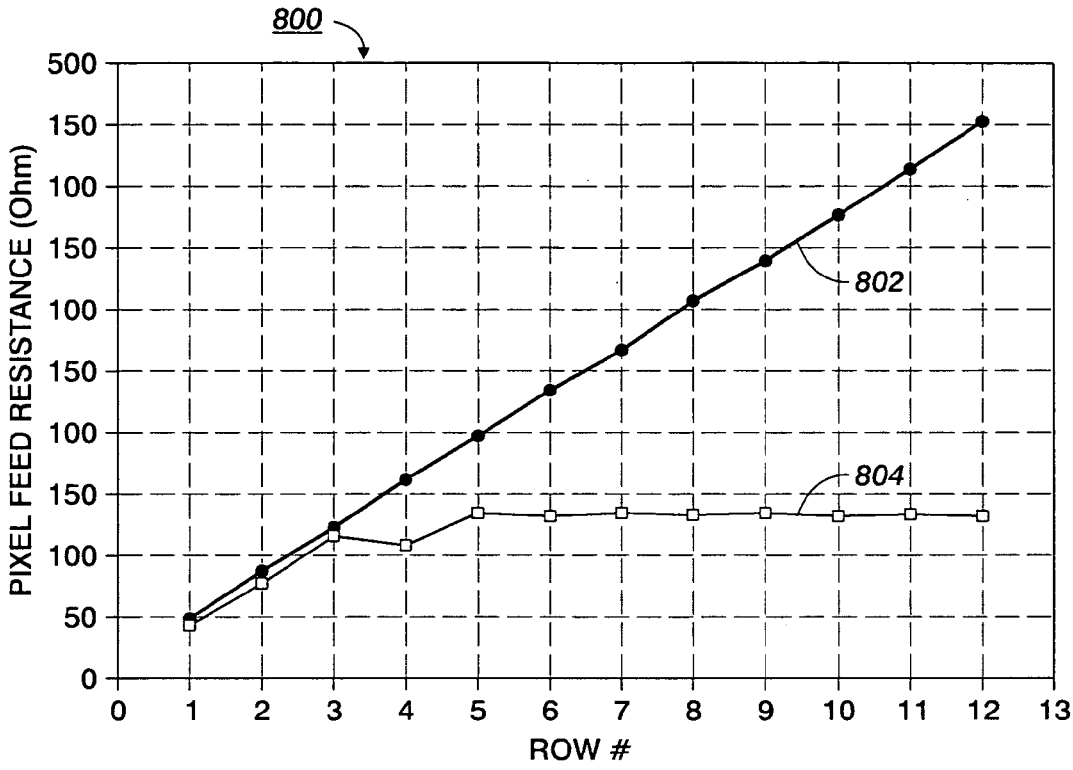
FIG. 8 is a graph illustrating the advantages of the configuration illustrated in FIG. 7.
Figure 9:
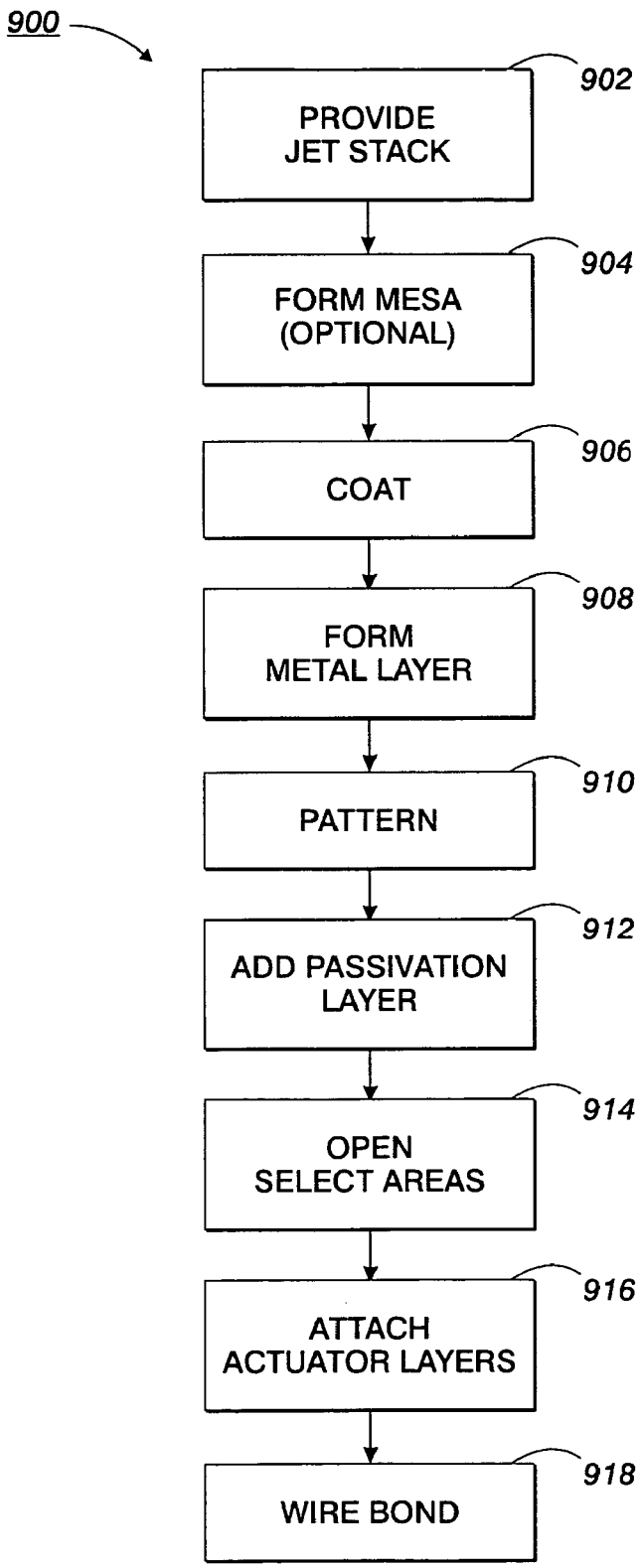
FIG. 9 is a flow chart illustrating a method for forming a presently described embodiment.
Figure 10:
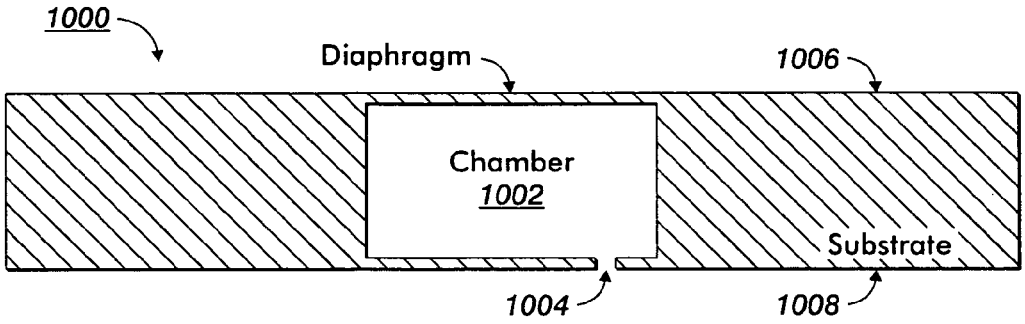
FIGS. 10 through 20 show a process flow cross section drawing illustrating a method for forming a presently described embodiment.
Figure 11:
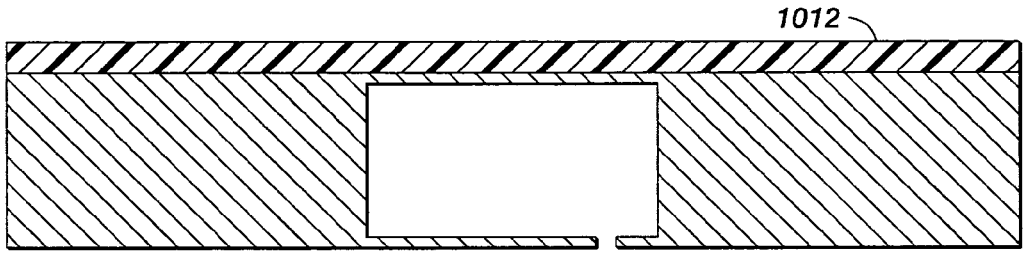
Figure 12:
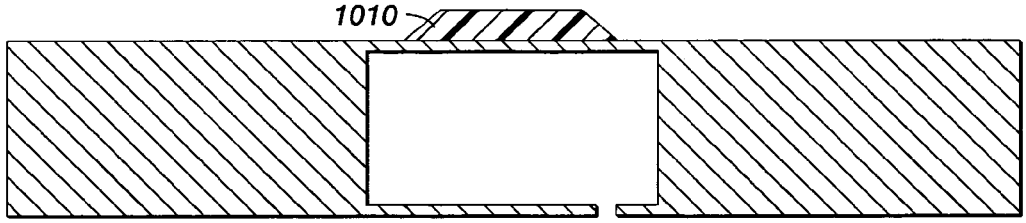

Referring now to FIG. 8, a graph 800 is illustrated. This graph 800 shows the resistance of the signal lines relative to the row number of the pixel elements. Notably, the line 802 shows the resistance for pixel elements of different rows in a configuration such as that of FIG. 6. Significantly, the resistance increases as the distance of the rows from the bond pads increases. However, the line 804 illustrates data obtained from a configuration such as that of FIG. 7. Here, the resistance of the lines is relatively constant for the different pixel rows. This reduces signal line delays and results in better overall uniformity for the printhead.

Referring now to FIGS. 9 and 10 through 20, a method 900 for forming a liquid drop ejector according to the presently described embodiments is illustrated. Initially, a suitable jet stack 1000 should be provided (at 902 and FIG. 10). It should be understood that a jet stack typically is formed of stainless steel material. The layers of the stainless material are configured so as to form appropriate ink channels 1002 and orifices 1004 for ejecting ink from the liquid drop ejector onto paper. In one form, the further processing of the presently described embodiments is performed on a side 1006 of the jet stack (e.g., the actuator side) opposite to the side 1008 (e.g., the jet side) containing jets for ink ejection onto paper. In addition, the jet stack may be provided with reference alignment marks and features (e.g., etched into the stack) to facilitate initial alignment of thin film features to the stainless steel substrate.

The surface of the jet stack is then prepared and a mesa 1010 is optionally formed thereon. The mesa is typically made from a layer 1012 of dielectric material and is patterned so that it increases the registration tolerances and attachment effectiveness that will be required when the actuator layers are attached to the jet stack (at 904 and FIGS. 11 and 12). The mesa 1010 also improves actuator performance. One of the functions of the mesa 1010 is to improve the actuator bottom electrode attachment to the chrome pixel electrode base on the mesa to form an electrical contact. The two dimensional size of the mesa relative to the body opening (under the diaphragm) and the actuator edge determines any actuator performance improvement.

Figure 13:
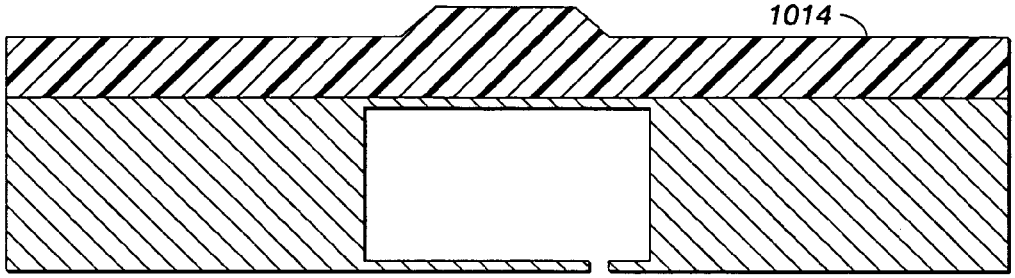

Next, the surface of the jet stack is coated with a layer 1014 of dielectric material (at 906 and FIG. 13). The dielectric material serves as an insulator to prevent unnecessary electrical connection to the jet stack, which is formed with conductive stainless steel. The dielectric thickness should be of sufficient thickness to have an acceptable parasitic capacitance for the pixel driving signal line RC time delay. This dielectric will also help sustain the driving voltages of the heater loop. The heater driving voltages should be designed to be low enough to achieve an acceptable dielectric voltage breakdown yield.

Figure 14:
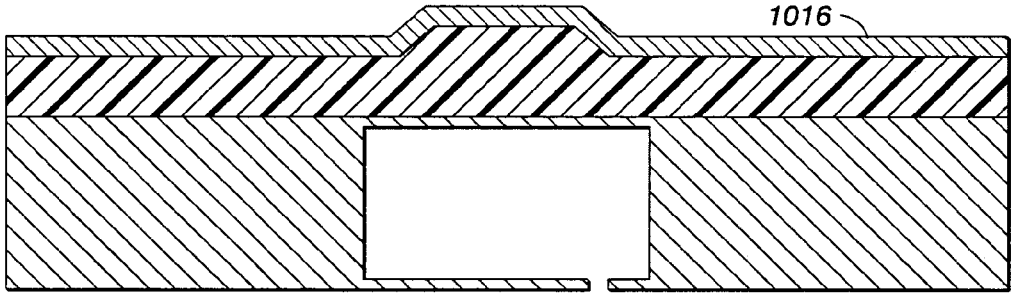

A metal layer 1016 having a measure of electrical resistance therein is then formed over the dielectric coat (at 908 and FIG. 14). The metal layer may comprise a variety of different positive temperature coefficient of electrical resistance (PTC) materials having a high temperature coefficient of resistance including chrome, nichrome, nickel and beryllium. Of course, other materials may be used including materials having a similar high temperature coefficient of resistance. Materials used may also include negative temperature coefficient of electrical resistance materials or zero temperature coefficient of electrical resistance materials (when used as an electrical interconnect). The metal layer may be formed of an organic substance or an inorganic substance.

Figure 15:
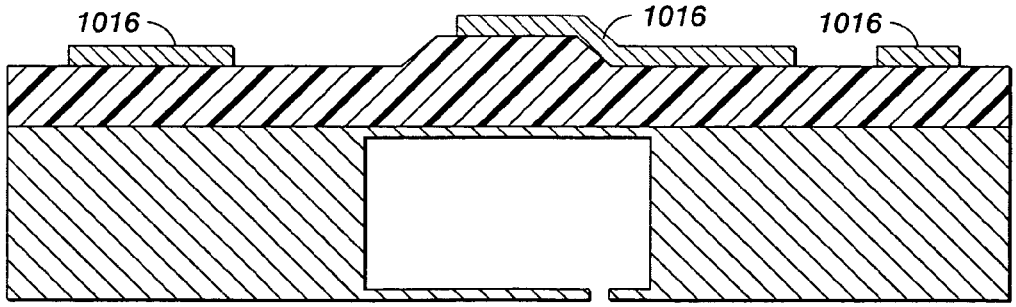

The metal layer is then patterned (at 910 and FIG. 15). Patterning may be accomplished in a variety of known manners. For example, photolithography techniques may be used. The pattern may be formed by masking the metal and subsequently etching away unmasked portions, or by a reverse lift off process, as is well known in the art. Patterning may also be accomplished by laser cutting the unwanted portions. No matter the method of patterning, however, it should be understood that the patterning technique will result in the formation of all the heater elements of the contemplated presently described embodiments, the thermistors, the interconnect lines, and bond pads. Providing all of these elements as thin film structures results in the operation and advantages described above.

Figure 16:
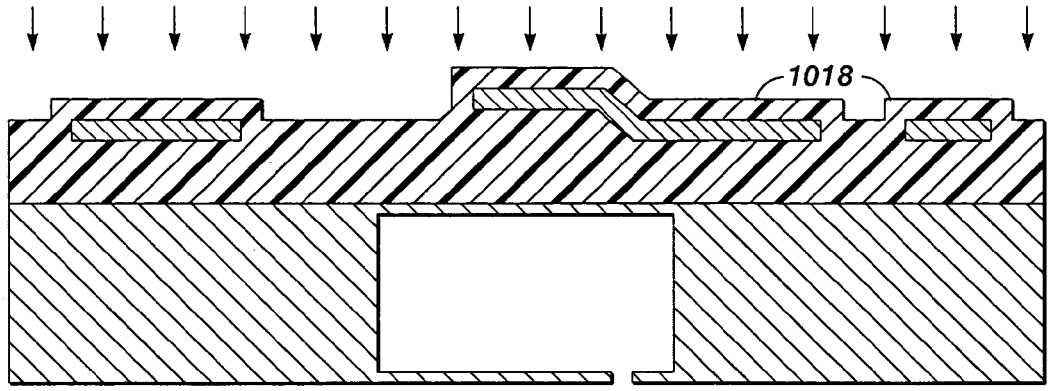
Figure 17:
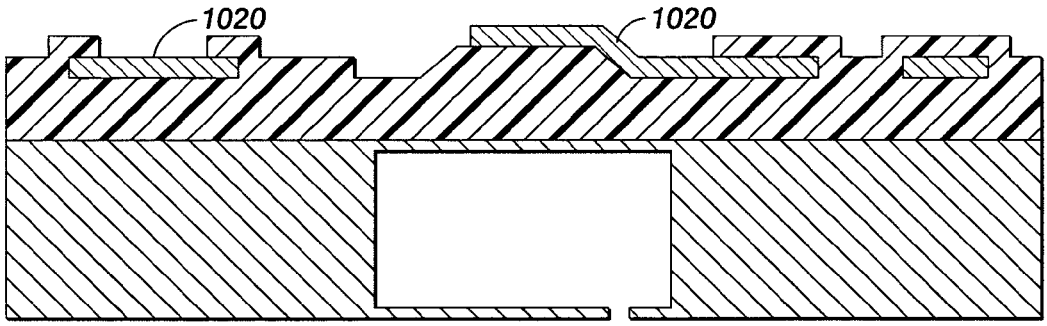

Next, a passivation layer 1018 is formed (at 912 and FIG. 16). This will serve as a scratch resistant barrier and a moisture barrier to protect the integrity of the metal layer. Selected portions (at 1020) of the passivation layer are then removed (at 914 and FIG. 17) so that electrical contact can be made where needed. For example, the bond pads and the pixel elements may require electrical contact from the actuator layer that will be attached.

The above fabrication process flow description detailed the embodiment of a reduced single metal layer process where the patterned metal layer define the pixel electrode contact pad, the signal line interconnect, the heater elements, the temperature sensors (thermistors), the bond pads etc. This reduced single metal layer embodiment has the advantage and simplicity of saving process steps which leads to higher process yield and reduced fabrication time. Other fabrication embodiments using multiple layers of metal and dielectric are also possible.

Figure 18:
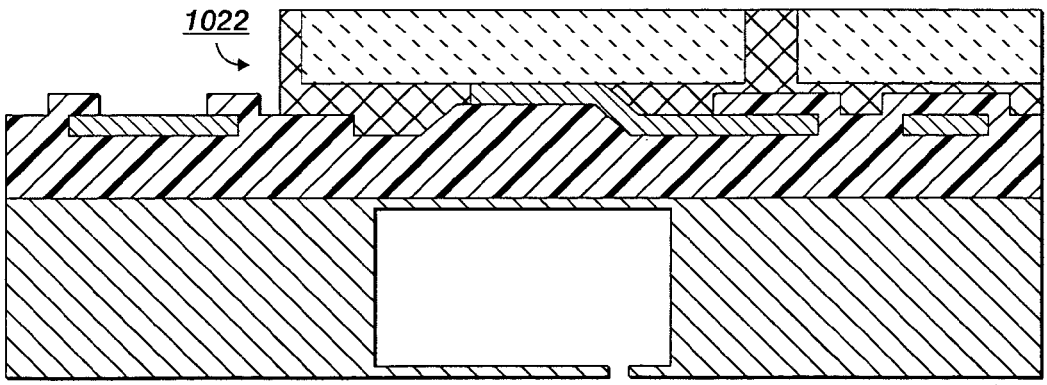
Figure 19:
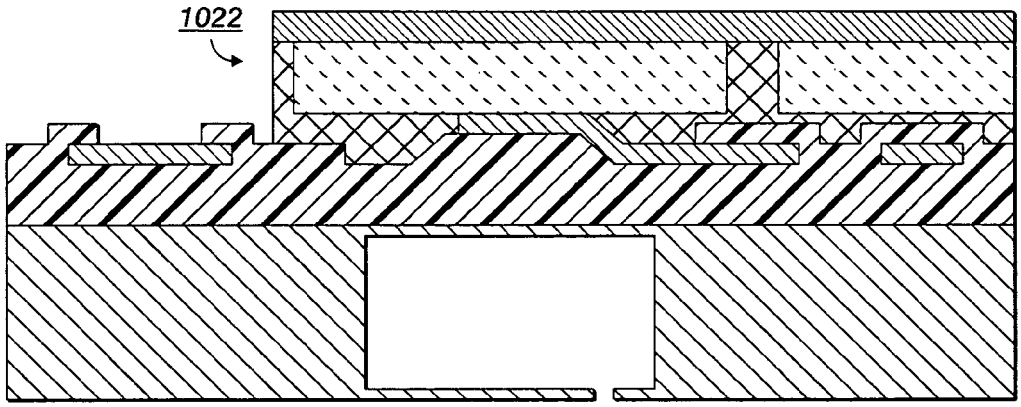
Figure 20:
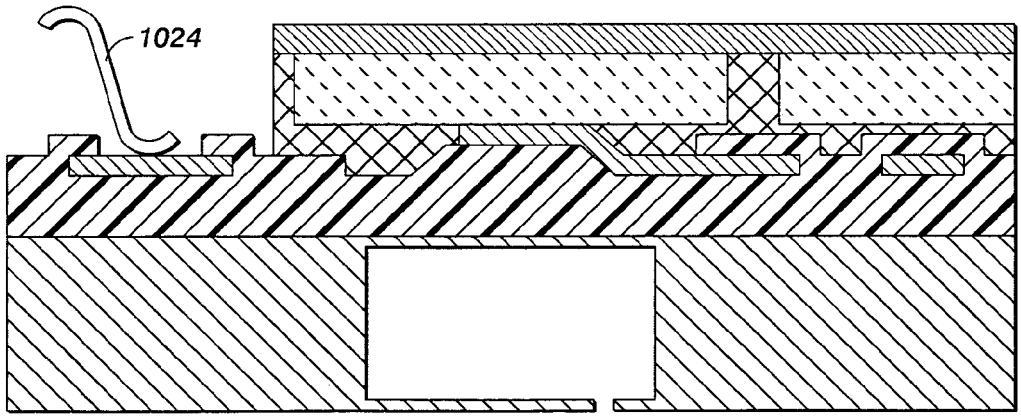

The actuator layer 1022 is then attached (at 916 and FIGS. 18 and 19). This process will be apparent to those skilled in the art and will, at least in one form, include the alignment of actuators with pixel elements. Last, the drive circuit of the actuator elements is wire bonded to the bond pads of the jet stack (at 918 and FIG. 20). In one form, aluminum wire bonds 1024 are used. In addition, a transition barrier buffer material may be used between the wire bond and the metal layer to improve wire bondability and reliability. Still further, reference alignment marks and features may be used near the bond pads to provide accurate optical wire bond alignment. The process of wire bonding and its encapsulation should result in improved reliability of the configuration.

Figure 23:
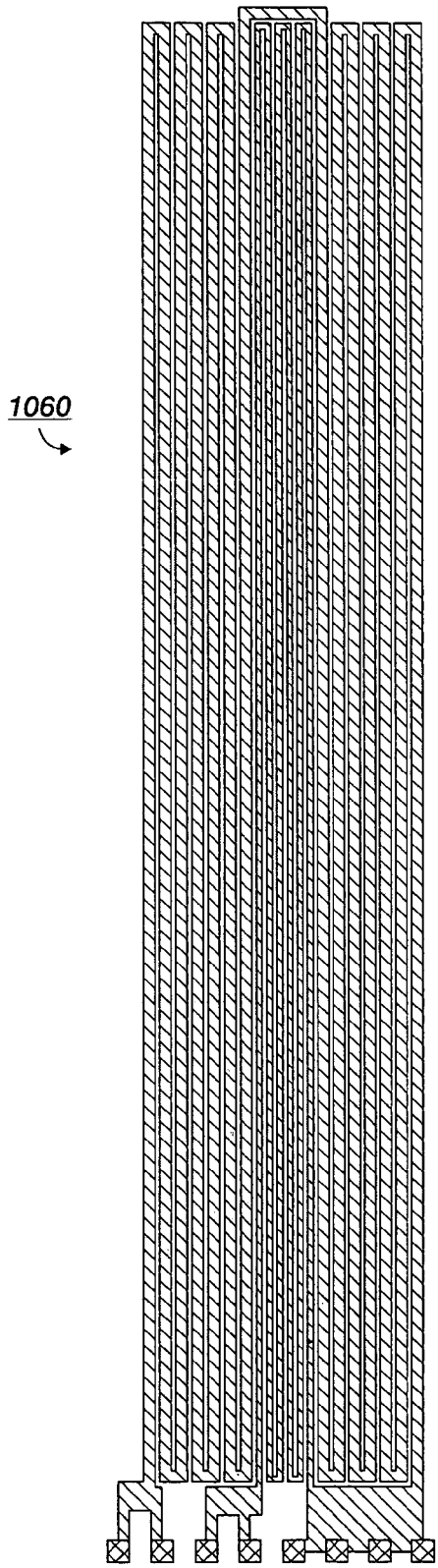
FIG. 23 is an illustration of a temperature sensor known as a common centroid thermistor; and, FIG. 24 is an enlarged view of a temperature sensor known as a common centroid thermistor.
Figure 24:
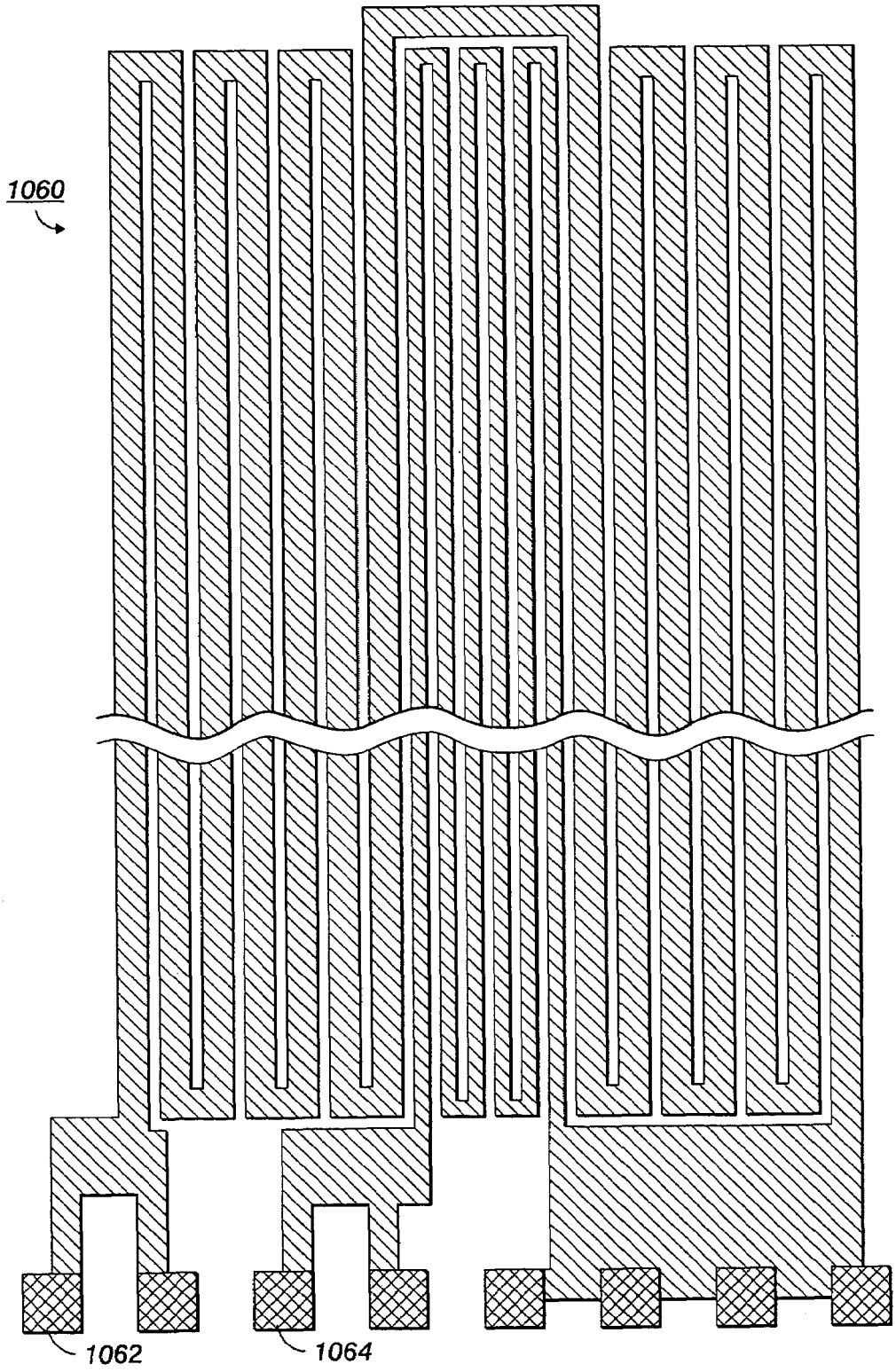

As noted above, the temperature sensor may take a variety of forms. The objective of an advantageously implemented temperature sensor is to provide for accuracy in sensed temperature. To that end, temperature sensors disposed on the same ejector (e.g. along the width or length of the jet stack) may be designed to be matching to the greatest extent possible to maximize end-to-end accuracy. Or, a common centroid configuration shown FIG. 22-24 may be used. In addition, neighboring heating elements, or neighboring metal traces and coverings, may serve as thermal shielding guards to provide temperature stability.

Figure 21:
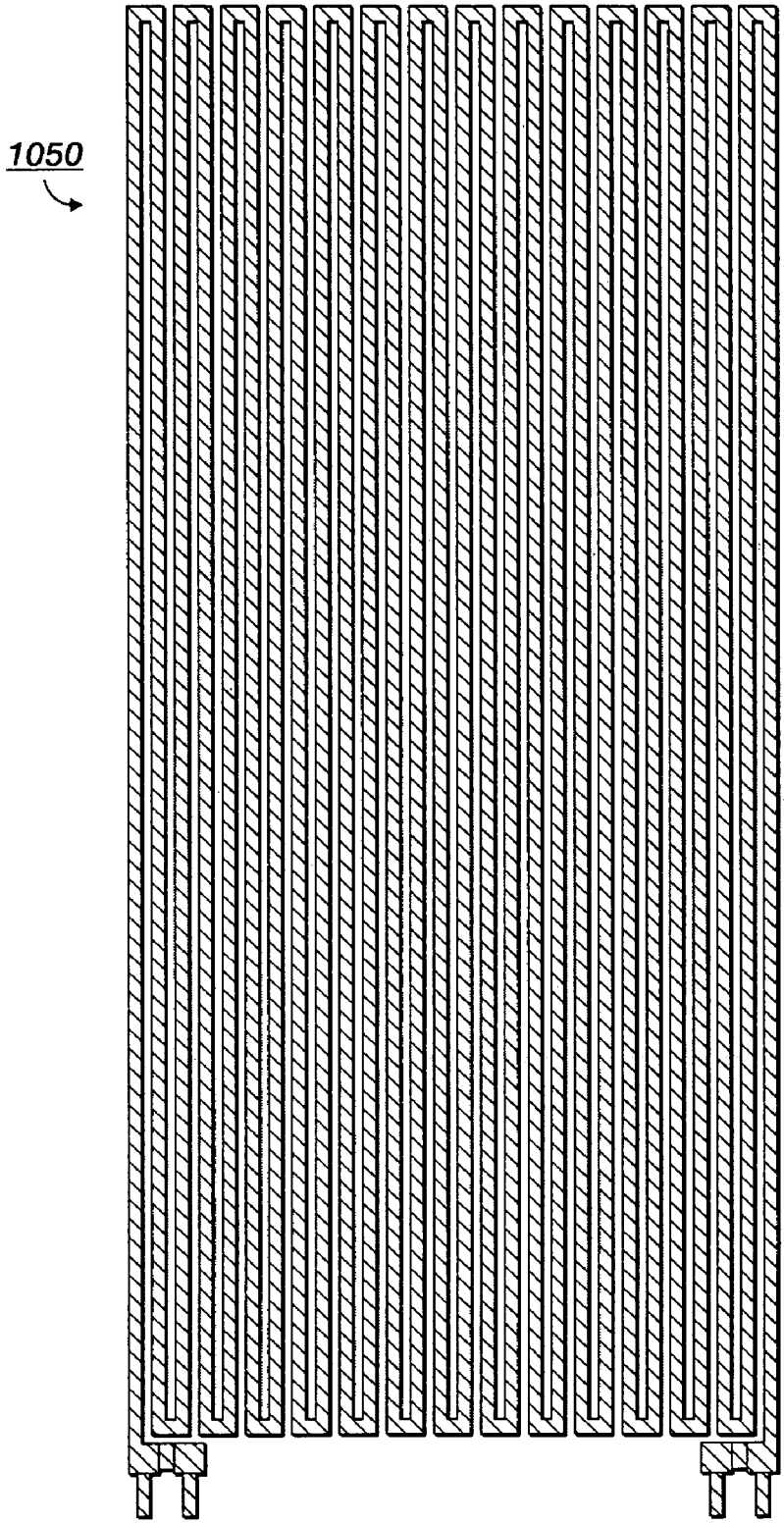
FIG. 21 is an illustration of a temperature sensor known as a thermistor.

As illustrated in FIG. 21, a temperature sensor takes the form of a thermistor 1050. Note that it is formed of parallel lines of material connected to suitable bond pads and/or terminals. Its function is to provide a temperature dependent resistance value that scales fairly linearly with temperature.

Another temperature sensor that can be constructed is a thermocouple (not illustrated). In this regard, a thermocouple junction may be formed as a result of the contact between two dissimilar thin film or thick film metals or the contact between the thin film or thick film metal and the jet stack.

Figure 22:
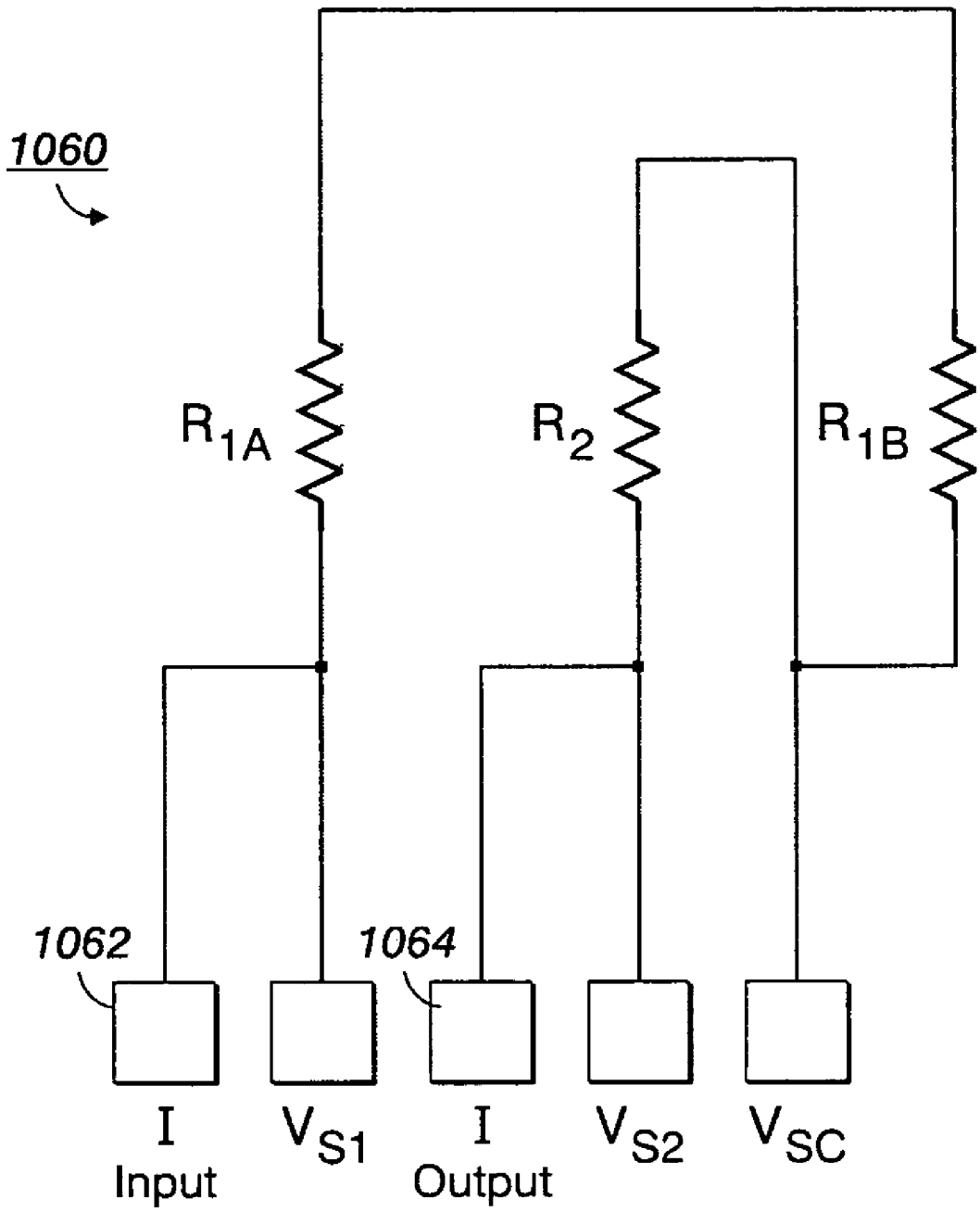
FIG. 22 is a schematic illustration of a temperature sensor known as a common centroid thermistor.

Referring to FIG. 22, another temperature sensor construction known as the common centroid thermistor 1060 (see FIGS. 22 through 24) is illustrated. In this form, an accurate computation of sensed temperature can be expected based on the configuration of the trace line widths and the electrical sheet resistivity. A common centroid configuration will also render the temperature sensing less dependent on orientation. For this illustrated common centroid thermistor, as shown in FIG. 22, the resistors $R_{1A}$ and $R_{1B}$ was designed to be of one line width while the center resistor $R_2$ was designed to be of half the line width of resistors $R_{1A}$ and $R_{1B}$. Resistors $R_{1A}$, $R_{1B}$ and $R_2$ all have the same line lengths and $R_1=R_{1A}+R_{1B}$. $R_{1A}$ and $R_{1B}$ are positioned around $R_2$ such that the two resistors, $R_1$ and $R_2$, share a common centroid, this reduces the effect of gradients in the processing and gradients of the temperature. The voltages are measured at the sensing points when a known current flows through the pad 1062 to the pad 1064. This separation of power and sensing eliminates effects due to parasitic resistances (in bond leads, pads, etc.). Noise pick up is also reduced by this differential sensing. If we calculate $R_T=1/(1/R_1-1/(2*R_2))$, the value of $R_T$ can be shown to be independent of the process variability of resistor width, if processing is close to uniform in the local area. If the processing impact on width is zero, then $R_T/2=R_1=R_2$.

The exemplary embodiment has been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A liquid drop ejector comprising:

a pixel zone, defined by a plurality of pixel elements, on a surface of the ejector;

thin film or thick film heater elements having electrical resistance disposed on the surface of the ejector in the pixel zone, the heater elements encompassing at least one of the pixel elements; and, at least one thin film or thick film temperature sensor operative to provide feedback temperature control for the thin film heater elements.

2. The liquid drop ejector as set forth in claim 1 wherein the thin film or thick film heater elements and the at least one temperature sensor are formed of an organic substance or an inorganic substance.

3. The liquid drop ejector as set forth in claim 1 wherein the thin film or thick film heater elements are formed of a material having a positive temperature coefficient of electrical resistance.

4. The liquid drop ejector as set forth in claim 1 wherein the thin film or thick film heater elements are formed of a material having a negative temperature coefficient of electrical resistance.

5. The liquid drop ejector as set forth in claim 1 wherein the thin film or thick film temperature sensor is formed from one of positive temperature coefficient of electrical resistance material or negative temperature coefficient of electrical resistance material.

6. The liquid drop ejector as set forth in claim 5 wherein the thin film or thick film temperature sensors are formed along the length of the ejector to be matching so as to maximize end-to-end sensed temperature accuracy.

7. The liquid drop ejector as set forth in claim 5 wherein the at least one thin film or thick film temperature sensor are in a common centroid configuration to maximize temperature sensing accuracy.

8. The liquid drop ejector as set forth in claim 7 wherein the at least one temperature sensor is comprised of a set of resistors with which thin or thick film material electrical sheet resistivity and trace line widths can be extracted leading to an accurate computation of sensed temperature.

9. The liquid drop ejector as set forth in claim 7 wherein the at least one temperature sensor is comprised of a set of thin or thick film resistors disposed in at least one orientation so as to make temperature sensing less dependent on sensor orientation.

10. The liquid drop ejector as set forth in claim 5 wherein the thin film or thick film temperature sensor includes a neighboring thermal shield guarding as provided by heater elements to effect more accurate and stable temperature sensing.

11. The liquid drop ejector as set forth in claim 5 wherein the thin film or thick film temperature sensor includes neighboring electrical shield guarding as provided by metal traces and coverings to effect more accurate and stable temperature sensing with better signal to noise ratio.

12. The liquid drop ejector as set forth in claim 1 wherein the liquid drop ejector comprises stainless steel material.

13. The liquid drop ejector as set forth in claim 1 wherein the heater elements form loops encompassing selected pixels within the pixel zone and selective areas outside the pixel zone.

14. The liquid drop ejector as set forth in claim 1 further comprising second heater elements formed of material having a positive or negative temperature coefficient of electrical resistance (PTC or NTC) on the surface of the liquid drop ejector outside the pixel zone.

15. The liquid drop ejector as set forth in claim 1 further comprising electrical interconnect(s) formed of material having a positive or negative temperature coefficient of electrical resistance (PTC or NTC) on the surface of the liquid drop ejector to make an electrical common ground connection to the ejector via an electrical insulator between the electrical interconnect and a jet stack of the ejector.

16. The liquid drop ejector as set forth in claim 1 wherein the thin film or thick film heater elements are operative to be individually controlled.

17. The liquid drop ejector as set forth in claim 1 wherein the thin film or thick film heaters are grouped in heater segments, the segments being operative to be individually controlled.

18. The liquid drop ejector as set forth in claim 17 wherein adjacent segments are positioned in an overlapping configuration.

19. The liquid drop ejector as set forth in claim 1 wherein the pixel elements are each connected to an input/output pad by a signal line.

20. The liquid drop ejector as set forth in claim 19 wherein selected signal lines have a first width near corresponding pads that is less than a second width near corresponding pixel elements.

21. The liquid drop ejector as set forth in claim 20 wherein an increase in width from the first width to the second width is progressive.

22. The liquid drop ejector as set forth in claim 20 wherein the signal lines are formed of a thin film or a thick film, positive temperature coefficient of electrical resistance (PTC) or negative temperature coefficient of electrical resistance (NTC) material of electrical resistance.

* * * * *